US007290540B2

(12) United States Patent
Lu

(10) Patent No.: US 7,290,540 B2
(45) Date of Patent: Nov. 6, 2007

(54) PRACTICING APPARATUS FOR BASEBALL AND SOFTBALL

(75) Inventor: Sheng-Hsiao Lu, No. 23, Sia Mian Cuo, Gang Dong Cun, Si Gang Siang, Tainan Sian (TW)

(73) Assignee: Sheng-Hsiao Lu, Tainan Sian (TW)

( * ) Notice: Subject to any disclaimer, the term of this patent is extended or adjusted under 35 U.S.C. 154(b) by 45 days.

(21) Appl. No.: 11/086,704

(22) Filed: Mar. 22, 2005

(65) Prior Publication Data

US 2006/0213491 A1 Sep. 28, 2006

(51) Int. Cl.
*F41B 4/00* (2006.01)

(52) U.S. Cl. ..... 124/78; 124/6

(58) Field of Classification Search ..... 124/6, 124/78; 285/404, 189, 211
See application file for complete search history.

(56) References Cited

U.S. PATENT DOCUMENTS

| | | | | |
|---|---|---|---|---|
| 25,283 | A * | 8/1859 | Smith | 285/360 |
| 653,384 | A * | 7/1900 | Grove | 285/303 |
| 4,088,347 | A * | 5/1978 | Bruggemann et al. | 285/24 |
| 4,193,591 | A * | 3/1980 | Paulson | 124/78 |
| 4,632,088 | A * | 12/1986 | Bruce | 124/78 |
| 4,760,835 | A * | 8/1988 | Paulson et al. | 124/78 |
| 5,012,790 | A * | 5/1991 | Bates | 124/81 |
| 5,437,261 | A * | 8/1995 | Paulson et al. | 124/78 |
| 6,164,271 | A * | 12/2000 | Paulson et al. | 124/78 |
| 6,732,724 | B1 * | 5/2004 | Paulson et al. | 124/6 |
| 6,863,059 | B1 * | 3/2005 | Lee | 124/6 |

* cited by examiner

*Primary Examiner*—John A. Ricci
(74) *Attorney, Agent, or Firm*—Alan Kamrath; Kamrath & Associates P.A.

(57) ABSTRACT

A baseball and softball practicing apparatus includes a housing, a first feeding member mounted on the housing and having a first entrance, a second feeding member detachably mounted in the first feeding member and having a second entrance, and a locking device mounted on the first feeding member and detachably engaged with the second feeding member to lock the second feeding member in the first feeding member. Thus, the second feeding member is mounted on and removed from the first feeding member, so that the practicing apparatus can be used to select and change the baseball and the softball rapidly, thereby facilitating a user practicing the baseball or the softball.

9 Claims, 8 Drawing Sheets

PRACTICING APPARATUS FOR BASEBALL AND SOFTBALL

BACKGROUND OF THE INVENTION

1. Field of the Invention

The present invention relates to a practicing apparatus, and more particularly to a baseball and softball practicing apparatus.

2. Description of the Related Art

A conventional baseball and softball practicing apparatus for the in accordance with the prior art shown in FIGS. 6-8 comprises a housing 10 mounted on a stand 11, a ball throwing wheel 13 rotatably mounted on an inner side of the housing 10 and rotated by a motor 12, a feeding member 15 mounted on a front end of the housing 10 by a plurality of screws 14 and having an entrance 150 and two arc-shaped guide plates 16, and a press plate 18 adjustably mounted on the inner side of the housing 10 by a plurality of screws 17 and located above the ball throwing wheel 13. The press plate 18 has a bottom face provided with an arc-shaped guide member 19 that is movable with the press plate 18 to adjust a distance between the guide member 19 and the ball throwing wheel 13.

As shown in FIG. 7, the press plate 18 is located at a higher position, and the entrance 150 of the feeding member 15 having a greater diameter is exposed to allow insertion of a softball so that the softball enters the entrance 150 of the feeding member 15 and is clamped between the guide member 19 of the press plate 18 and the ball throwing wheel 13 to be ejected outward for use.

As shown in FIG. 8, the press plate 18 is located at a lower position, and the entrance 150' of another feeding member 15' having a smaller diameter is exposed to allow insertion of a baseball so that the baseball enters the entrance 150' of another feeding member 15' and is clamped between the guide member 19 of the press plate 18 and the ball throwing wheel 13 to be ejected outward for use.

However, it is necessary to successively screw and unscrew the screws 14 so as to replace the feeding member 15 and another feeding member 15' having a smaller diameter, thereby greatly causing inconvenience to a user in selecting and changing the baseball and the softball.

SUMMARY OF THE INVENTION

In accordance with the present invention, there is provided a practicing apparatus, comprising a housing, a first feeding member mounted on an end of the housing and having a first entrance, a second feeding member detachably mounted in the first feeding member and having a second entrance having a diameter smaller than that of the first entrance of the first feeding member, and a locking device mounted on the first feeding member and detachably engaged with the second feeding member to lock the second feeding member in the first feeding member.

The primary objective of the present invention is to provide a practicing apparatus that is available for mounting the baseball and softball simultaneously.

Another objective of the present invention is to provide a practicing apparatus, wherein the second feeding member is mounted on and removed from the first feeding member, so that the practicing apparatus can be used to select and change the baseball and the softball rapidly, thereby facilitating a user practicing the baseball or the softball.

A further objective of the present invention is to provide a practicing apparatus, wherein the user only needs to pull the pull ring to retract the locking shaft of the locking device inwardly so as to unlock the locking device, so that the second feeding member is mounted on and removed from the first feeding member easily and conveniently, thereby facilitating the user selecting and changing the baseball and the softball.

Further benefits and advantages of the present invention will become apparent after a careful reading of the detailed description with appropriate reference to the accompanying drawings.

DETAILED DESCRIPTION OF THE INVENTION

Figure 1:
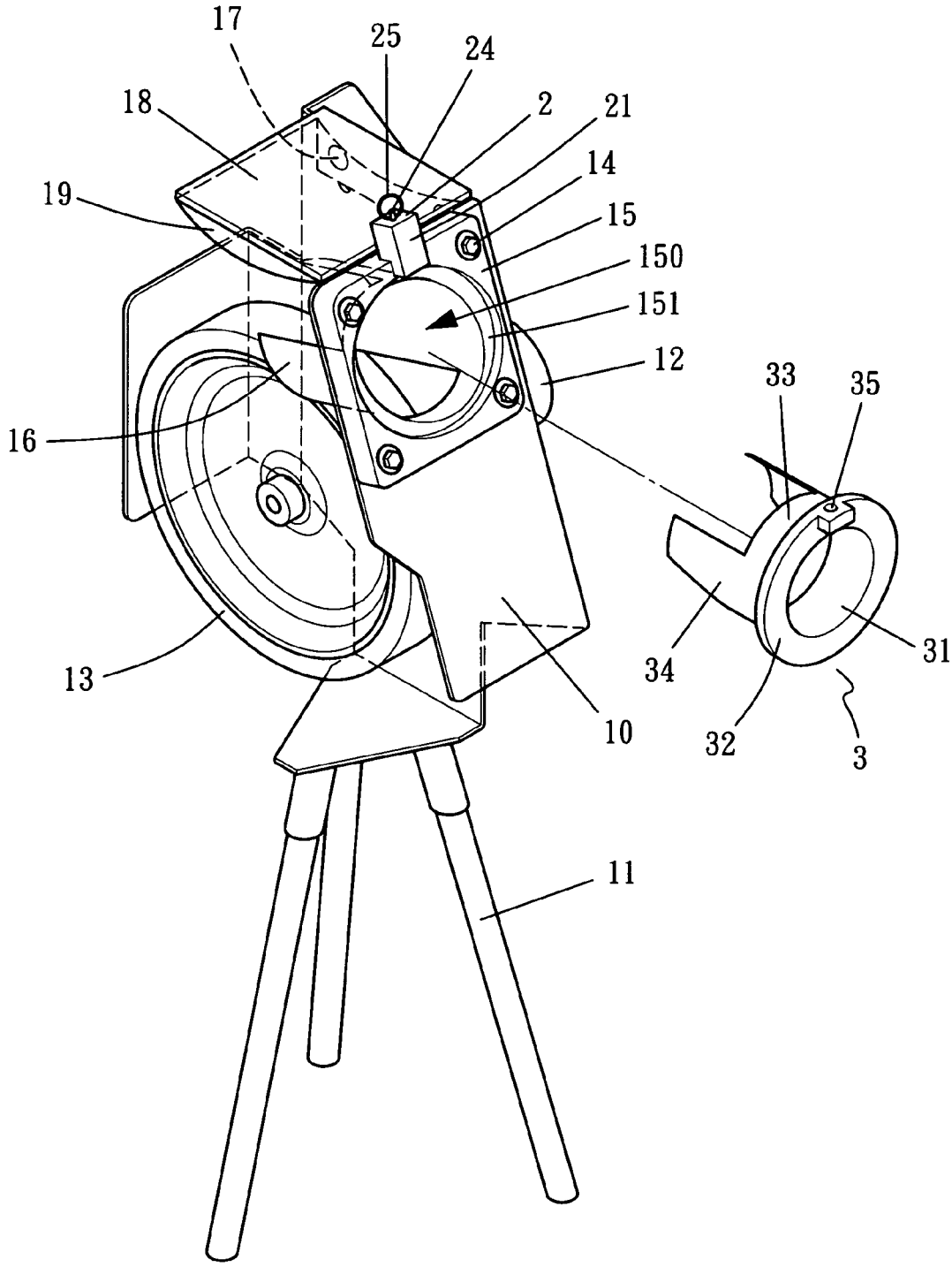
FIG. 1 is a partially exploded perspective view of a practicing apparatus in accordance with the preferred embodiment of the present invention.
Figure 2:
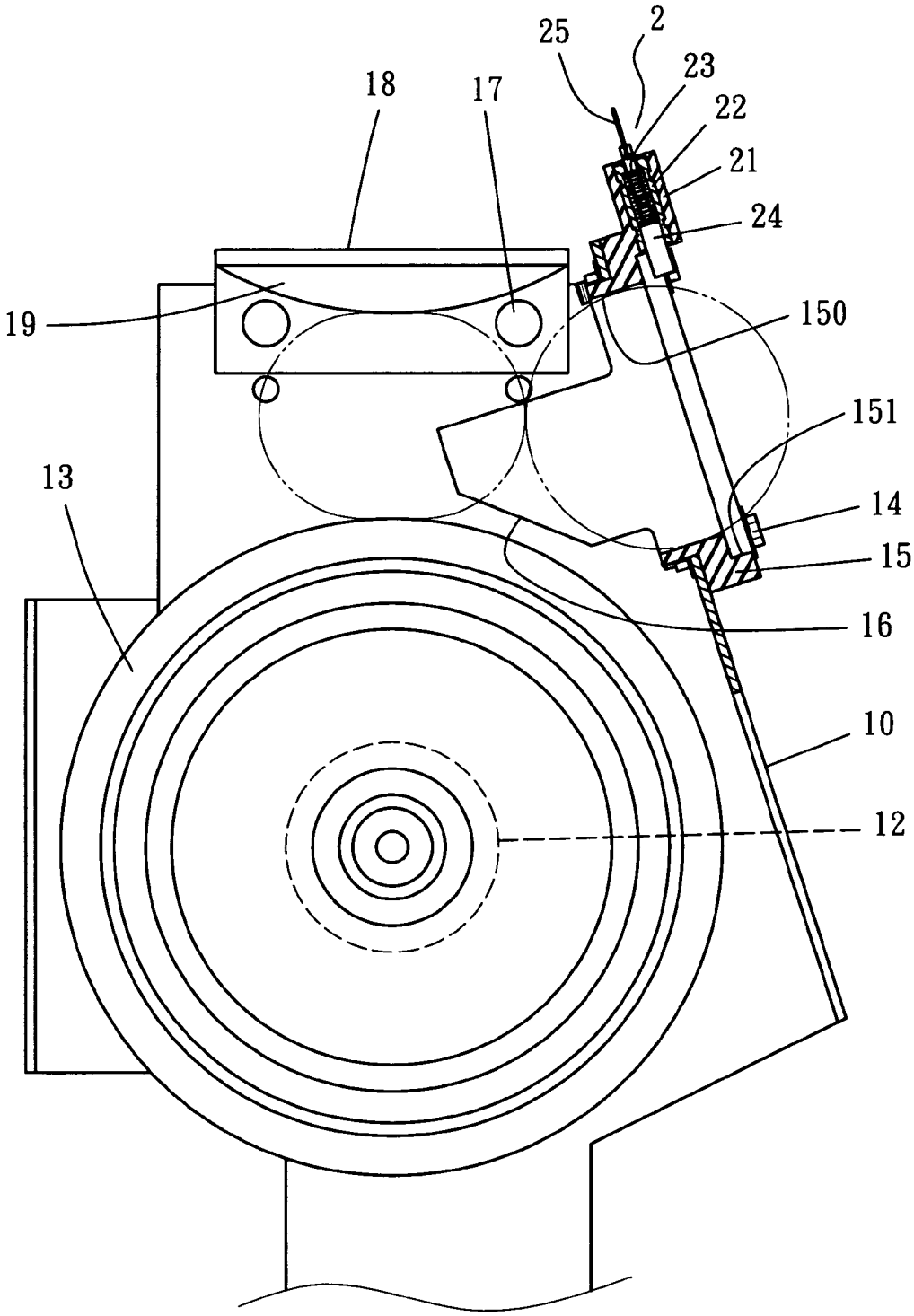
FIG. 2 is a partially plan cross-sectional assembly view of the practicing apparatus as shown in FIG. 1.
Figure 3:
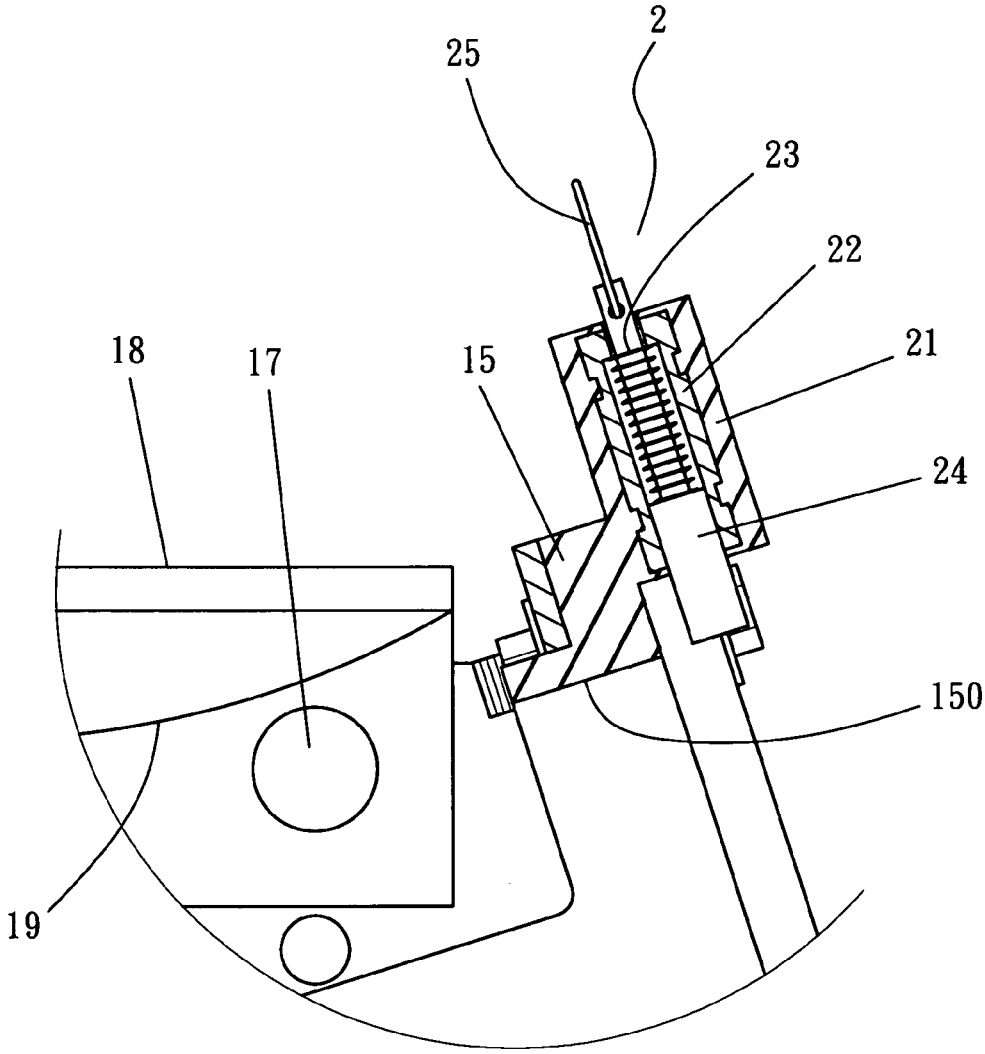
FIG. 3 is a locally enlarged view of the practicing apparatus as shown in FIG. 2.

Referring to the drawings and initially to FIGS. 1-3, a practicing apparatus in accordance with the preferred embodiment of the present invention comprises a housing 10 mounted on a stand 11, a ball throwing wheel 13 rotatably mounted on an inner side of the housing 10 and rotated by a motor 12, a first feeding member 15 mounted on a front end of the housing 10 and having a first entrance 150, a press plate 18 adjustably mounted on the inner side of the housing 10 and located above the ball throwing wheel 13, a second feeding member 3 detachably mounted in the first feeding member 15 and having a second entrance 31 having a diameter smaller than that of the first entrance 150 of the first feeding member 15, and a locking device 2 mounted on the first feeding member 15 and detachably engaged with the second feeding member 3 to lock the second feeding member 3 in the first feeding member 15.

The first feeding member 15 is mounted on the housing 10 by a plurality of screws 14. The first entrance 150 of the first feeding member 15 has a wall formed with an annular positioning groove 151. The first feeding member 15 has an inner side formed with two radially opposite arc-shaped guide plates 16.

The second feeding member 3 has a periphery formed with a cylindrical protruding flange 32 secured in the positioning groove 151 of the first feeding member 15. The protruding flange 32 of the second feeding member 3 has a periphery formed with a locking hole 35. The second feeding member 3 has a side formed with a cylindrical mounting portion 33 mounted in the first entrance 150 of the first feeding member 15 and two radially opposite arc-shaped guide plates 34 rested on the arc-shaped guide plates 16 of the first feeding member 15.

The press plate 18 is mounted on the housing 10 by a plurality of screws 17. The press plate 18 has a bottom face provided with an arc-shaped guide member 19 that is movable with the press plate 18 to adjust a distance between the guide member 19 and the ball throwing wheel 13.

The locking device 2 includes a housing 21 secured on a periphery of the first feeding member 15, a sleeve 22 mounted in the housing 21, a locking shaft 24 movably mounted in the sleeve 22 and having a lower end protruded outward from a lower end of the housing 21 and detachably locked in the locking hole 35 of the second feeding member 3 to lock the second feeding member 3 in the first feeding member 15 and an upper end protruded outward from an upper end of the housing 21, an elastic member 23 mounted on the locking shaft 24 and biased between the locking shaft 24 and the sleeve 22 to push the locking shaft 24 toward the locking hole 35 of the second feeding member 3, and a pull ring 25 secured on the upper end of the locking shaft 24 to facilitate a user pulling the locking shaft 24. The locking shaft 24 has a stepped shape, the upper end of the locking shaft 24 has a reduced diameter, and the elastic member 23 is mounted on the reduced upper end of the locking shaft 24.

In operation, referring to FIGS. 1-3, the second feeding member 3 is removed from the first feeding member 15, so that the first entrance 150 of the first feeding member 15 is exposed to allow insertion of a softball as shown in FIG. 2. At this time, the lower end of the locking shaft 24 of the locking device 2 is protruded outward from the lower end of the housing 21 by the elastic force of the elastic member 23, and the press plate 18 is located at a higher position.

In such a manner, the first entrance 150 of the first feeding member 15 is exposed to allow insertion of the softball so that the softball enters the first entrance 150 of the first feeding member 15 and is clamped between the guide member 19 of the press plate 18 and the ball throwing wheel 13 to be ejected outward for use.

Figure 4:
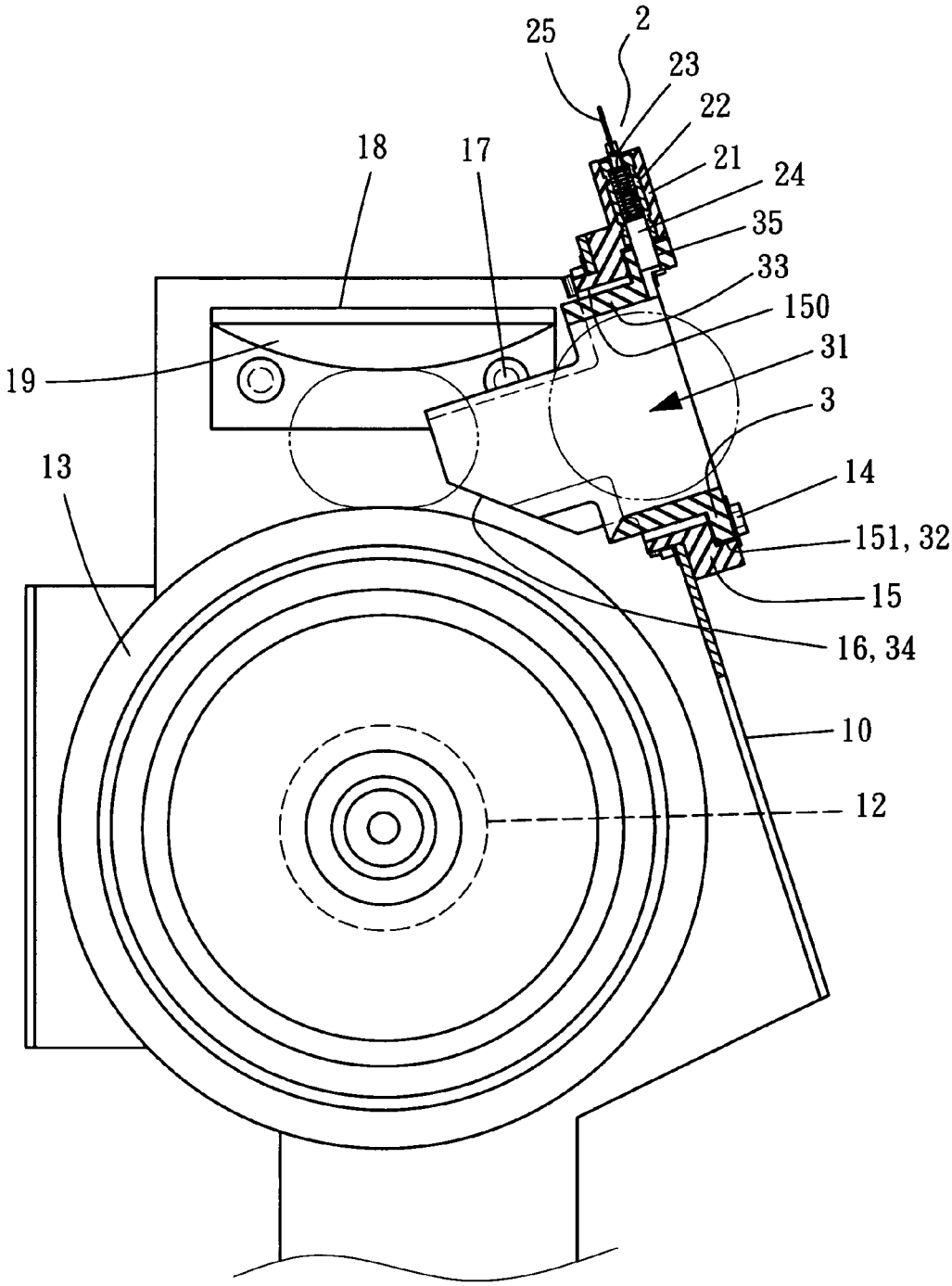
FIG. 4 is a plan cross-sectional assembly view of the practicing apparatus as shown in FIG. 1.

Alternatively, as shown in FIG. 4, the pull ring 25 is pulled upward to retract the lower end of the locking shaft 24 of the locking device 2 into the lower end of the housing 21, so that the second feeding member 3 is inserted into the first feeding member 15. At this time, the protruding flange 32 of the second feeding member 3 is received in the positioning groove 151 of the first feeding member 15, the arc-shaped guide plates 34 of the second feeding member 3 are rested on the arc-shaped guide plates 16 of the first feeding member 15, and the locking hole 35 of the second feeding member 3 is aligned with the locking shaft 24 of the locking device 2. Then, the force applied on the pull ring 25 is removed to release the locking shaft 24, so that the lower end of the locking shaft 24 of the locking device 2 is moved outward by the restoring force of the elastic member 23 and locked in the locking hole 35 of the second feeding member 3 to position the second feeding member 3 in the first feeding member 15. Thus, the second entrance 31 of the second feeding member 3 is exposed to allow insertion of a baseball. At this time, the press plate 18 is located at a lower position.

In such a manner, the second entrance 31 of the second feeding member 3 is exposed to allow insertion of the baseball so that the baseball enters the second entrance 31 of the second feeding member 3 and is clamped between the guide member 19 of the press plate 18 and the ball throwing wheel 13 to be ejected outward for use When a user wishes to remove the second feeding member 3 from the first feeding member 15, the pull ring 25 is pulled upward to retract the lower end of the locking shaft 24 of the locking device 2 inwardly, thereby detaching the lower end of the locking shaft 24 from the locking hole 35 of the second feeding member 3 so that the second feeding member 3 can be removed from the first feeding member 15.

Accordingly, the second feeding member 3 is mounted on and removed from the first feeding member 15, so that the practicing apparatus can be used to select and change the baseball and the softball rapidly, thereby facilitating a user practicing the baseball or the softball. In addition, the user only needs to pull the pull ring 25 to retract the locking shaft 24 of the locking device 2 inwardly so as to unlock the locking device 2, so that the second feeding member 3 is mounted on and removed from the first feeding member 15 easily and conveniently, thereby facilitating the user selecting and changing the baseball and the softball.

Figure 5:
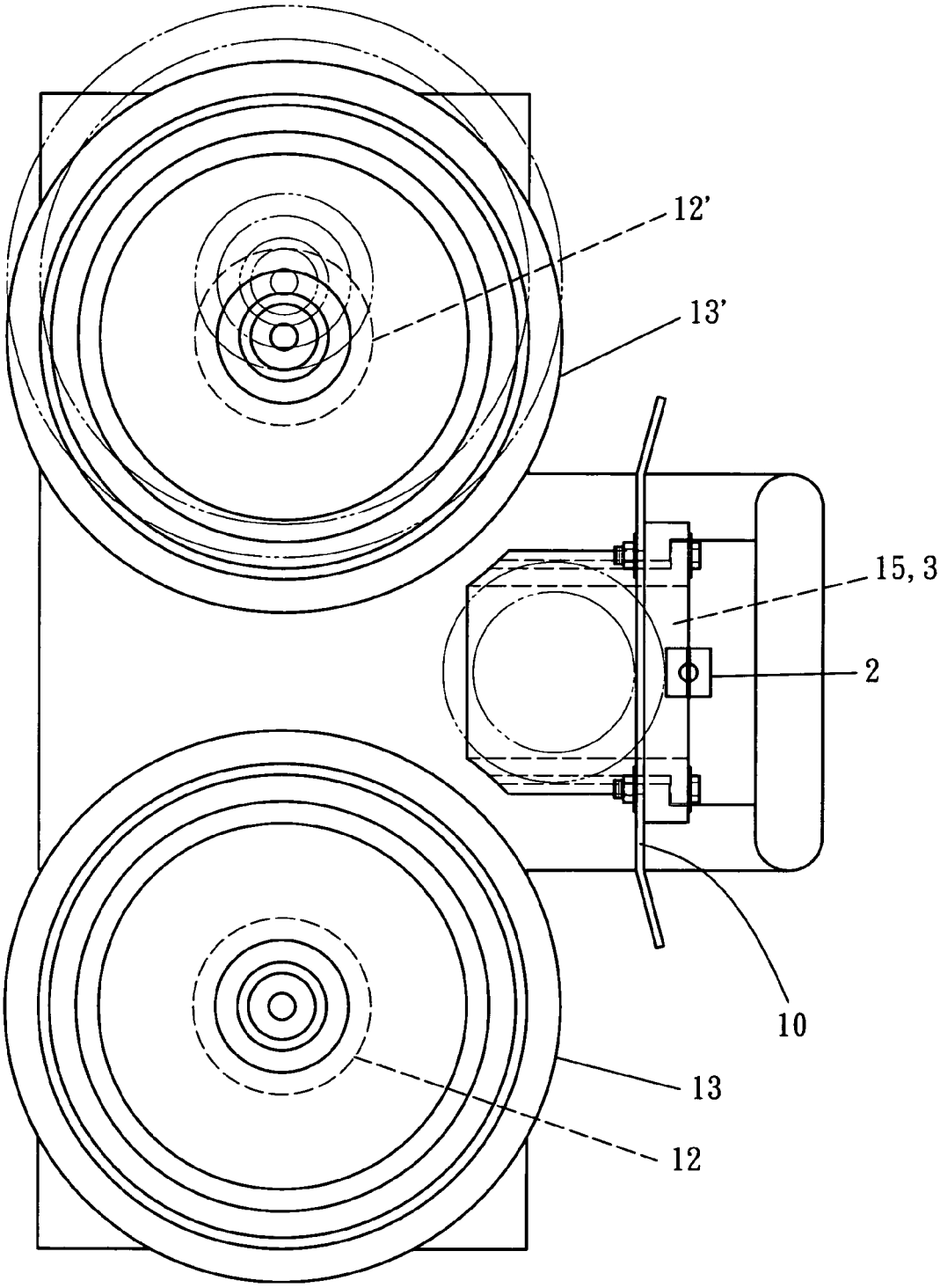
FIG. 5 is a plan view of a practicing apparatus in accordance with another preferred embodiment of the present invention.
Figure 6:
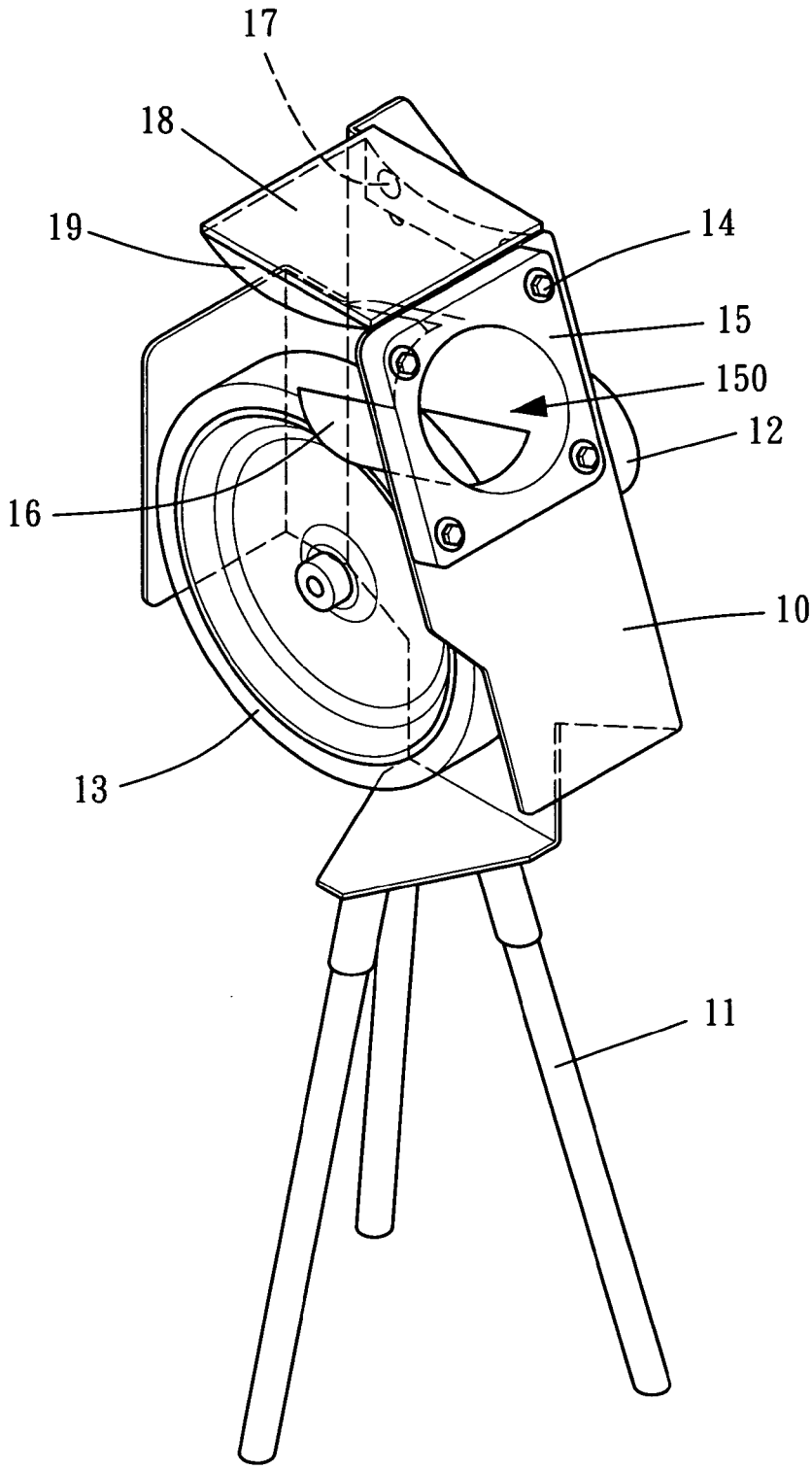
FIG. 6 (PRIOR ART)
FIG. 6 is a perspective view of a conventional practicing apparatus in accordance with the prior art.
Figure 7:
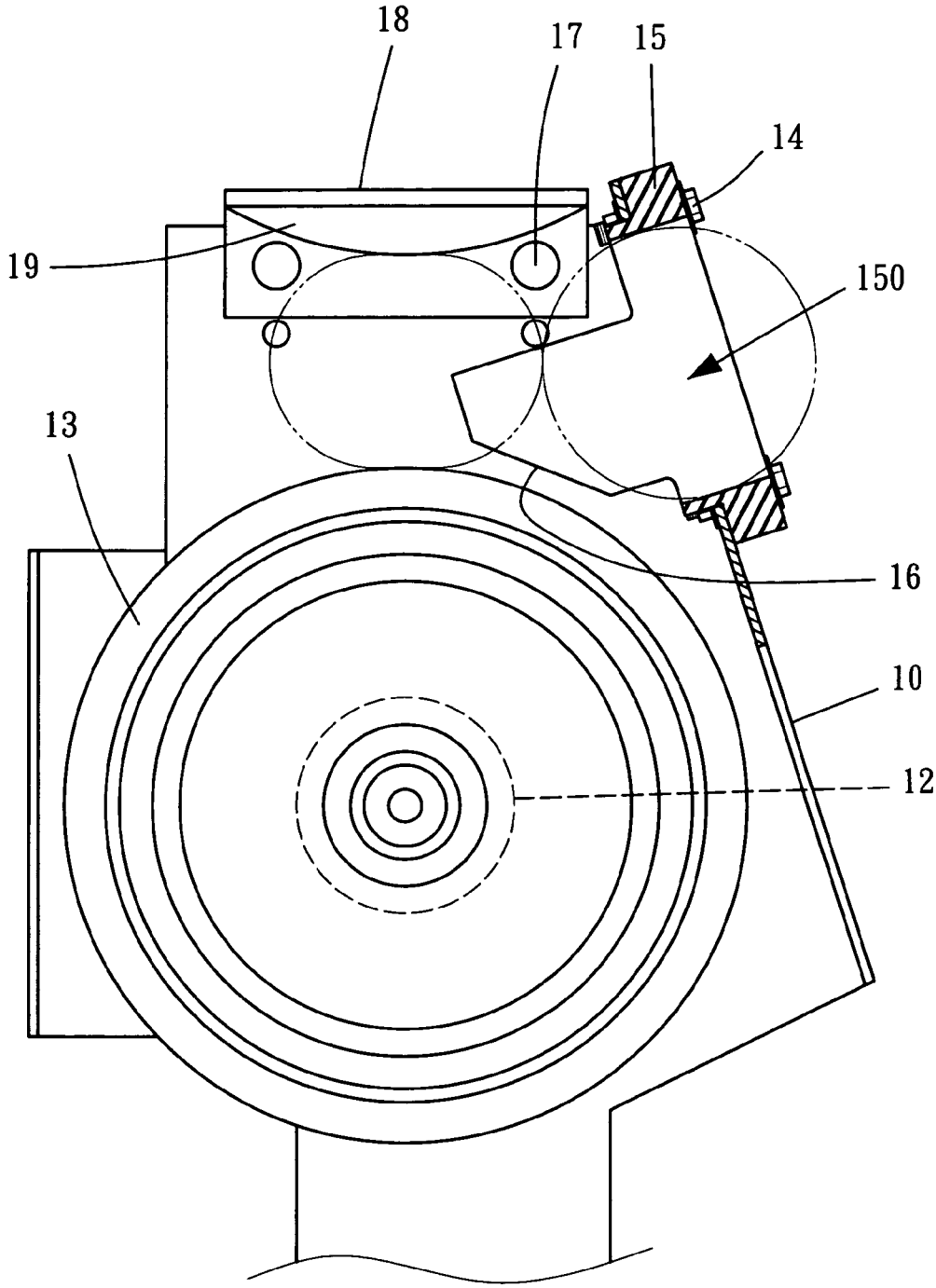
FIG. 7 (PRIOR ART)
FIG. 7 is a plan cross-sectional assembly view of the conventional practicing apparatus as shown in FIG. 6.
Figure 8:
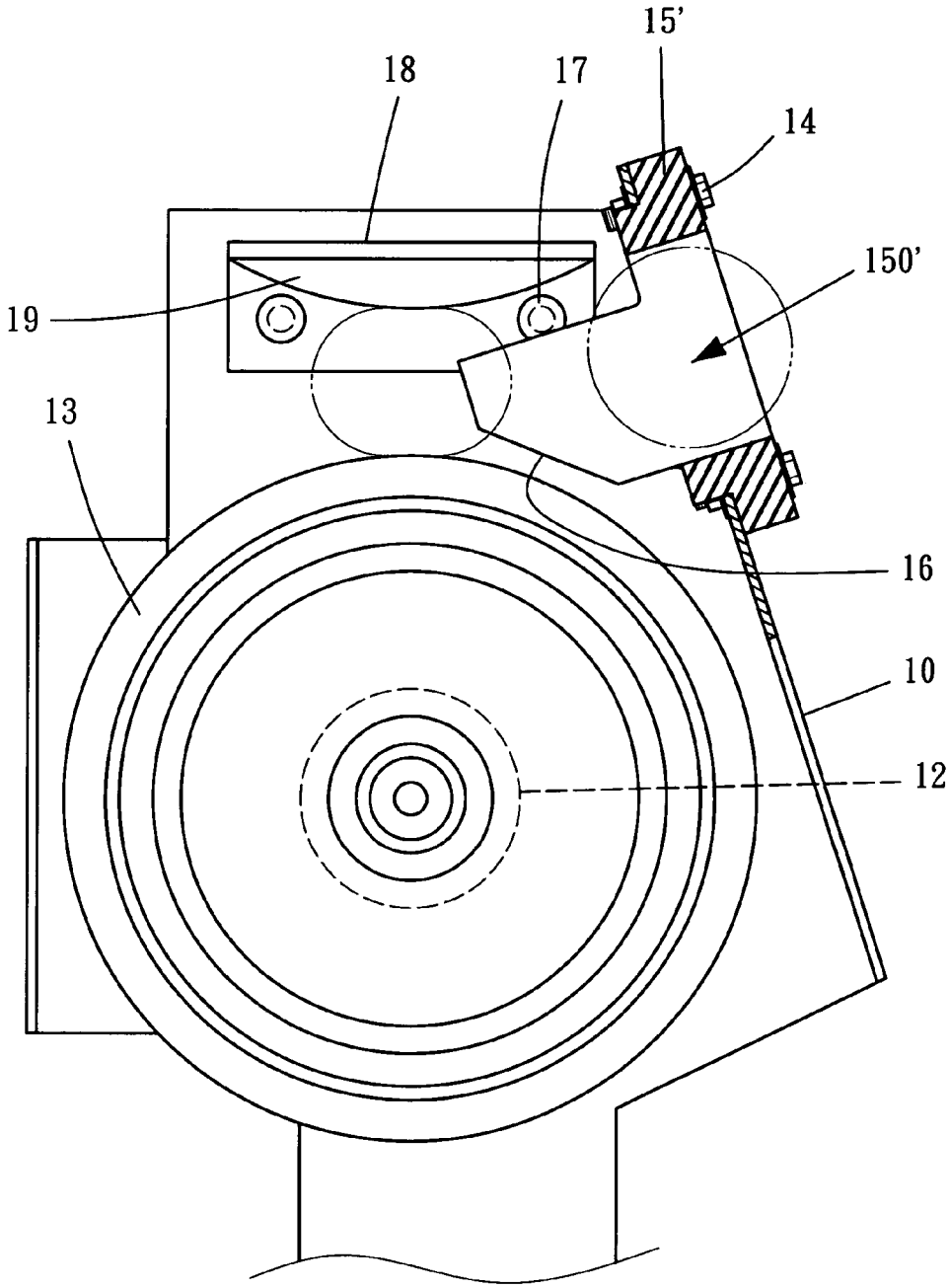
FIG. 8 (PRIOR ART)
FIG. 8 is a plan cross-sectional assembly view of the conventional practicing apparatus as shown in FIG. 6.

As shown in FIG. 5, the practicing apparatus in accordance with another preferred embodiment of the present invention comprises two ball throwing wheels 13 and 13' each rotatably mounted on an inner side of the housing 10 and each rotated by a motor 12 and 12' respectively so as to replace the press plate 18 and the guide member 19. In addition, one of the two ball throwing wheels 13 and 13' is adjustably mounted on the housing 10 so as to change a distance between the two ball throwing wheels 13 and 13'.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A practicing apparatus, comprising:

a housing;

a first feeding member mounted on an end of the housing and having a first entrance;

a second feeding member detachably mounted in the first feeding member and having a second entrance having a diameter smaller than that of the first entrance of the first feeding member; and a locking device mounted on the first feeding member and detachably engaged with the second feeding member to lock the second feeding member in the first feeding member;

wherein the second feeding member has a periphery formed with a locking hole, and the locking device includes a locking shaft retractably mounted on the first feeding member and detachably locked in the locking hole of the second feeding member to lock the second feeding member in the first feeding member;

the locking device further includes a housing secured on a periphery of the first feeding member, and a sleeve mounted in the housing, and the locking shaft is movably mounted in the sleeve and has a lower end protruded outward from a lower end of the housing and detachably locked in the locking hole of the second feeding member;

the locking device further includes an elastic member mounted on the locking shaft and biased between the locking shaft and the sleeve to push the locking shaft toward the locking hole of the second feeding member.

2. The practicing apparatus in accordance with claim 1, wherein the locking device further includes a pull ring secured on the upper end of the locking shaft to facilitate a user pulling the locking shaft.

3. The practicing apparatus in accordance with claim 1, wherein the locking shaft has a stepped shape.

4. The practicing apparatus in accordance with claim 1, wherein the upper end of the locking shaft has a reduced diameter, and the elastic member is mounted on the reduced upper end of the locking shaft.

5. The practicing apparatus in accordance with claim 1, wherein the locking hole of the second feeding member is aligned with the locking shaft of the locking device when the second feeding member is mounted in the first feeding member.

6. The practicing apparatus in accordance with claim 1, further comprising a ball throwing wheel rotatably mounted on an inner side of the housing and rotated by a motor, and a press plate adjustably mounted on the inner side of the housing and located above the ball throwing wheel, wherein the press plate has a bottom face provided with an arc-shaped guide member that is movable with the press plate to adjust a distance between the guide member and the ball throwing wheel.

7. The practicing apparatus in accordance with claim 1, further comprising two ball throwing wheels each rotatably mounted on an inner side of the housing and each rotated by a motor respectively.

8. The practicing apparatus in accordance with claim 7, wherein one of the two ball throwing wheels is adjustably mounted on the housing so as to change a distance between the two ball throwing wheels.

9. A practicing apparatus, comprising:

a housing;

a first feeding member mounted on an end of the housing and having a first entrance;

a second feeding member detachably mounted in the first feeding member and having a second entrance having a diameter smaller than that of the first entrance of the first feeding member; and a locking device mounted on the first feeding member and detachably engaged with the second feeding member to lock the second feeding member in the first feeding member;

wherein the first feeding member has an inner side formed with two radially opposite arc-shaped guide plates, and the second feeding member has two radially opposite arc-shaped guide plates rested on the arc-shaped guide plates of the first feeding member.

* * * * *